United States Patent [19]

Berthold et al.

[11] Patent Number: 4,920,856

[45] Date of Patent: May 1, 1990

[54] AXIAL PISTON MACHINE OF THE SWASHPLATE OR BENT AXIS TYPE HAVING SLOT CONTROL AND PRESSURE BALANCING PASSAGES

[75] Inventors: Heinz Berthold, Horb; Josef Beck, Haigerloch; Manfred Lotter, Neu-Ulm, all of Fed. Rep. of Germany

[73] Assignee: Brueninghaus Hydraulik GmbH, Horb, Fed. Rep. of Germany

[21] Appl. No.: 221,118

[22] Filed: Jul. 19, 1988

[30] Foreign Application Priority Data

Jul. 30, 1987 [DE] Fed. Rep. of Germany ..... 3725361

[51] Int. Cl.[5] ..... F04B 1/20

[52] U.S. Cl. ..... 91/6.5; 91/499

[58] Field of Search ..... 91/499, 486, 487, 6.5, 91/506

[56] References Cited

U.S. PATENT DOCUMENTS

| | | | |
|---|---|---|---|
| 2,633,104 | 3/1953 | Lauck et al. | 91/505 |
| 2,963,983 | 12/1960 | Wiggermann | 91/6.5 |
| 3,585,901 | 6/1971 | Moon, Jr. | 91/6.5 |
| 3,699,845 | 10/1972 | Ifield | 91/6.5 |
| 3,956,969 | 5/1976 | Hein | 91/487 |
| 4,096,786 | 6/1978 | Schauck | 91/6.5 |

FOREIGN PATENT DOCUMENTS

| | | | |
|---|---|---|---|
| 54-43302 | 4/1979 | Japan | 91/506 |
| 56-55909 | 10/1982 | Japan | 91/499 |
| 306642 | 5/1972 | U.S.S.R. | 91/487 |

OTHER PUBLICATIONS

"Olhydraulik and Pneumatik" 20 (1976), No. 1, pp. 27 to 33.

*Primary Examiner*—Leonard E. Smith

*Attorney, Agent, or Firm*—Scully, Scott, Murphy & Presser

[57] ABSTRACT

In an axial piston machine of the swashplate or bent axis type having slot control and a pressure balancing passage at the inlet end of the high pressure (HP) control slot, erosion caused by the jet of the pressure balancing passage is prevented by providing at the inlet end of the HP-control slot an interference jet passage starting from the high pressure whose opening is arranged so that the directions of flow of the pressure balancing passage and the outlet of the interference jet passage intersect.

13 Claims, 2 Drawing Sheets

AXIAL PISTON MACHINE OF THE SWASHPLATE OR BENT AXIS TYPE HAVING SLOT CONTROL AND PRESSURE BALANCING PASSAGES

TECHNICAL FIELD OF THE INVENTION

The invention relates to an axial piston machine of the swashplate or bent axis type having slot control and a pressure balancing passage at the inlet end of the high pressure control slot.

BACKGROUND OF THE INVENTION AND PRIOR ART

The purpose of the pressure balancing passages is to soften the shock effect of the pressure changes in the cylinder chambers arising in the transition region between the low pressure (LP) region and the high pressure (HP) region. This purpose is served by the pressure balancing passages through which a relatively gentle adaptation of the pressures in the cylinder chambers to one another occurs before the cylinder opening of the respective cylinder chamber lies in the cross-sectional region of the HP passage. By reducing the abrupt effect of the pressure changes in the cylinder chambers the running noise of the axial piston machine due to the abrupt effect can be reduced.

With the known pressure balancing passages the running noise of the axial piston machines can indeed be reduced, but the pressure balancing passages lead to damage to the axial piston machine by wear, namely to erosion of the walls against which the jets of fluid emerging from the pressure balancing passages strike, namely in particular:

- jet erosion of the control passage walls in the cylinder, and
- cavitation erosion of the control surface and of the bearing surface of the control plate.

Damage of this kind occurs in both pump and motor operation of the axial piston machine.

OBJECT OF THE INVENTION

The object of the invention is to avoid or at least substantially reduce such erosion in an axial piston machine of the kind described in the introduction.

BRIEF DESCRIPTION OF THE INVENTION

In the arrangement according to the invention there is an additional interference jet passage whose openings is aligned so that the streams of liquid issuing in operation from the pressure balancing passage and the interference jet passage intersect, whereby at least the erosive energy of the stream from the pressure balancing passage is substantially reduced. At the same time the kinetic energy of the interference jet passage is reduced so that erosion that might be generated by this stream can be prevented or considerably reduced. In both cases the directional flows are so to speak made turbulent.

It is possible, within the scope of the invention, to arrange the interference jet passage so that it opens in the pressure balancing passage, or else it can open at a distance from the pressure balancing passage or its opening. In the first case, the streams intersect in the region of the pressure balancing passage, while in the second case the streams or jets intersect outside the pressure balancing passage. In both cases the erosive energy of the stream or streams and the jet or jets can be substantially reduced. What is required is that the streams or jets intersect, i.e. that the direction of the stream or jet of the interference jet passage is transverse to the stream or the jet of the pressure balancing passage. The angle between the streams or jets can either be substantially a right angle or else an acute angle or an obtuse angle. In the last case the effectiveness of the interference jet is more efficient than in particular in the first case owing to the opposed directions of the streams or jets.

The arrangement according to the invention is particularly suitable for pressure balancing passages in the form of notches in the control surface, particularly those converging in the direction of the stream, which owing to the special way they run lead to the aforementioned jet and cavitation erosion of the walls of the control passages in the cylinder and of the control surface.

Axial piston machines with the arrangement according to the invention are, owing to reduced running noise, particularly suitable for passenger vehicles in particular motor vehicles.

Further developments of the invention which improve the functioning strived for or lead to arrangements that are simple, economical to manufacture and practicable.

For example, through one preferred arrangement, additional volumetric losses are prevented.

BRIEF DESCRIPTION OF THE DRAWINGS

The invention will now be described in more detail with reference to a preferred exemplary embodiment shown in the drawings, in which.

DETAILED DESCRIPTION OF A PREFERRED EMBODIMENT OF THE INVENTION

Figure 1:
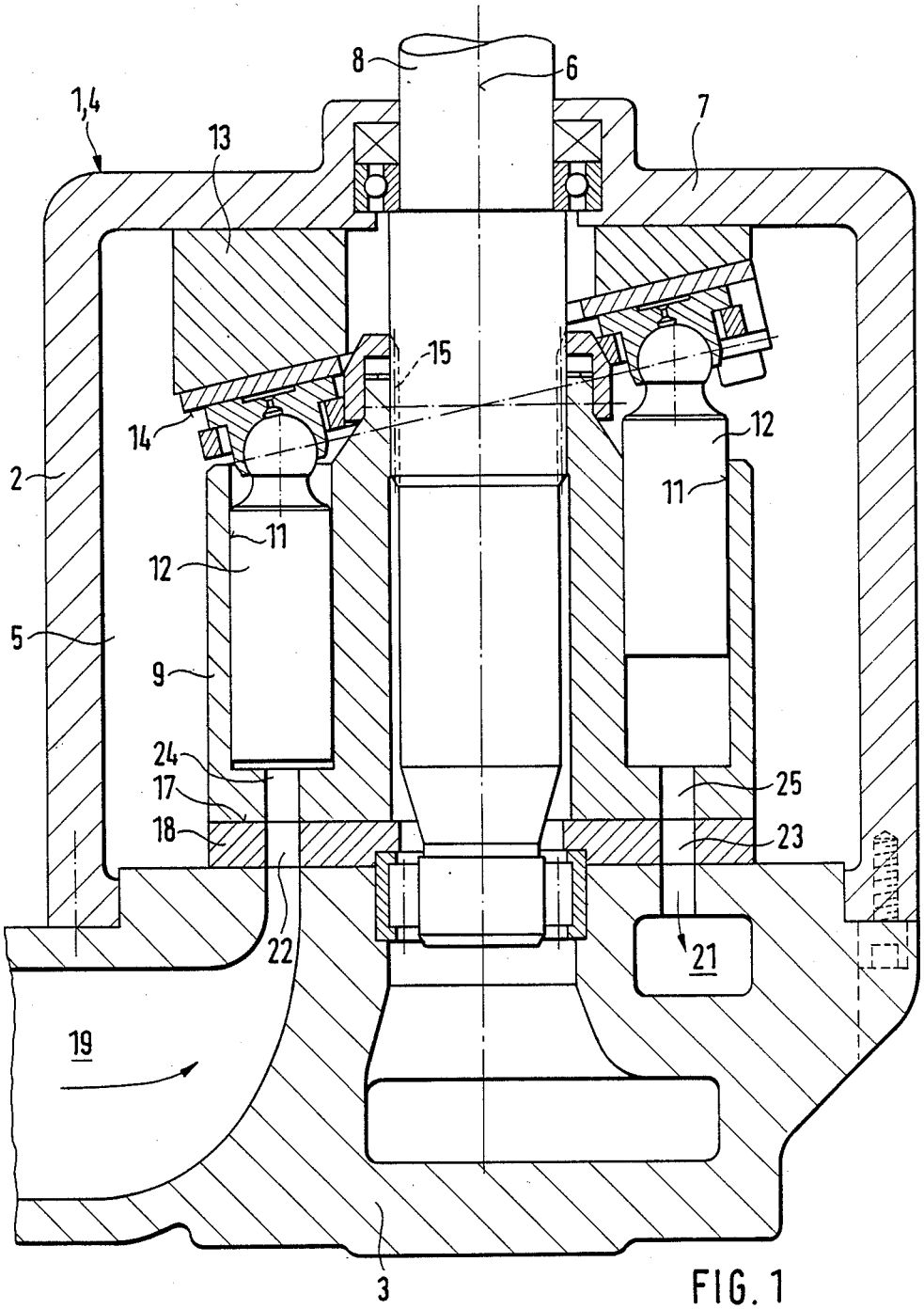
FIG. 1 shows, in axial section, an axial piston machine of the swashplate type as a pump.

The important individual parts of the axial piston machine, generally indicated by 1 in FIG. 1, are a housing 4 comprising a pot-like housing part 2 and a housing cover 3, a drive shaft 8 passing through the space 5 within the housing 4 along the middle axis 6 and mounted in bearings in the lateral wall 7 of the housing part 2 and in the housing cover 3, a cylinder 9 having a plurality of piston bores 11 arranged diametrically opposite one another or in the form of a star and running substantially axially, in which correspondingly dimensioned pistons 12 are displaceably mounted and which can be driven by a swash plate 13 supported on the housing 4, the setting angle of which may be adjustable, or by its inclined bearing surface 14.

In the present exemplary embodiment the cylinder 9 comprises a cylinder barrel, which is arranged on the drive shaft 8 by means of a central hole, is secured against rotation by a toothed coupling 15 and has its end 16 facing away from the bearing surface 14 abutting against a control surface 17 formed on a control plate 18 which is secured to the housing cover 3 by screws or centering pins, and two input and output lines 19, 21 for the fluid, in the present case hydraulic oil, which are connected to the piston bores 11 by kidney-shaped control passages 22, 23 in the control plate 18 and by axial throughput passages 24, 25. As is shown clearly in FIG. 2, the kidney-shaped control passage 23 of the HP side is divided into three sections by two bridges 26, in contrast to the LP-side.

Figure 2:
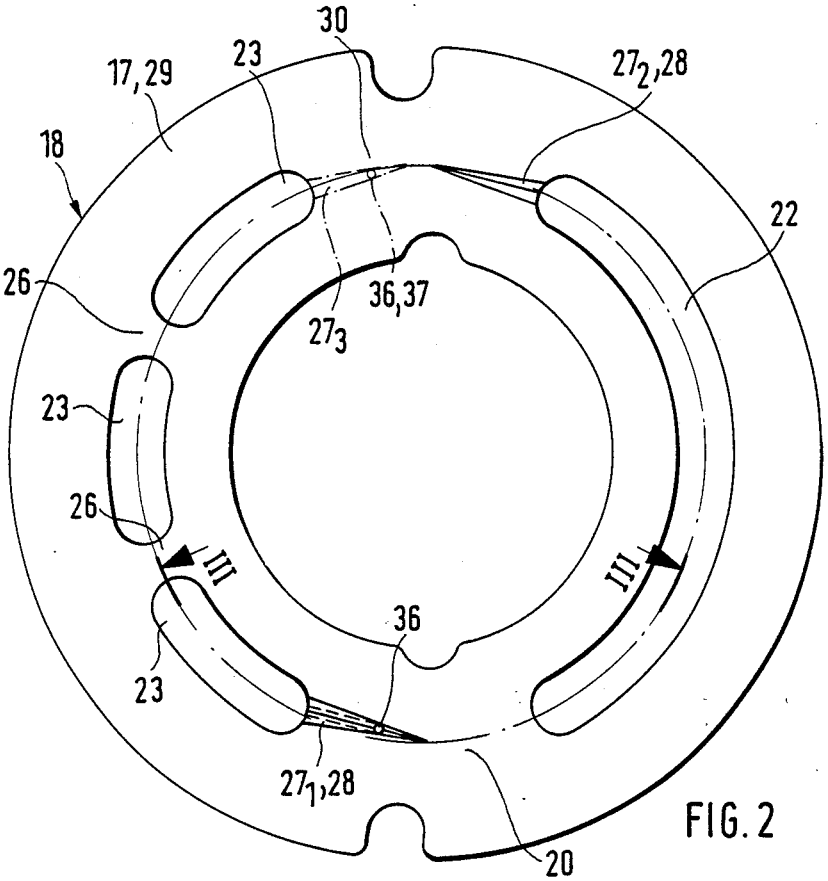
FIG. 2 shows a plan view of the control surface of the pump.
Figure 3:
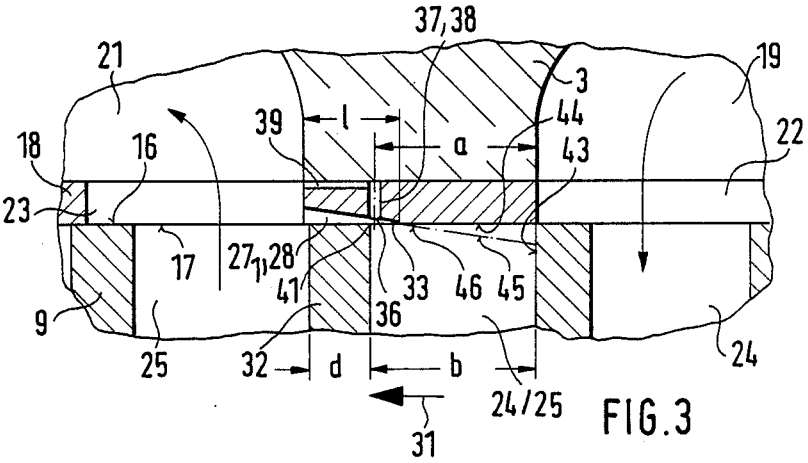
FIG. 3 shows the section III—III in FIG. 2.

As shown in FIGS. 2 and 3, there are pressure balancing passages, generally indicated by $27_1$, $27_2$, in the transition regions between the HP and LP regions, which in the present exemplary embodiment are formed by notches 28 in the face 29 of the control surface 17. The pressure balancing passages $27_1$, $27_2$ or notches 28 extend counter to the direction of rotation 31 of the cylinder 9, namely from the HP-control passage 23 towards the neighbouring end of the LP-control passage 22 opposite, and in the other transition region from the LP-control passage towards the neighbouring end of the opposite HP-control passage 23. The, in this case triangular, cross-section of the pressure balancing passages $27_1$, $27_2$ diverges towards the respective control passage 22, 23, i.e., in the direction of the rotational movement (direction of rotation 31) of the cylinder 9. In the present case, the divergence of the pressure balancing passages $27_1$, $27_2$ is due to the fact that towards the respective control passages 22, 23 they are inclined relative to the face 29 of the control surface. The length L of the pressure balancing passages $27_1$, $27_2$ can be either less or greater (FIG. 3) than the thickness d of the wall 32 covering them between two neighbouring throughput passages 24, 25. The arrangement can preferably be such that the wall 32 uncovers the opening 33 of the pressure balancing passage $27_1$, extending from HP, before the throughput passage 24 into which the pressure from the HP region is propagated through the pressure balancing passage 27, leaves the LP-control passage 22. That is to say, at a point when the connection between the LP-control passage 22 and the throughput passage 24/25 in the transition region is closed (cf. FIG. 3), the opening 33 of the respective pressure balancing passage $27_1$ is already slightly open.

At least the pressure balancing passage $27_1$ in the transition region 20 in the direction of rotation 31 between LP and HP, i.e. the one starting from HP, is provided in the region of its opening 33 or in the region of its free end with the opening 36 of an interference jet passage, generally indicated by 37, which starts from the output line 21 containing the high pressure, or in this case from the HP-control passage 22, and thereby intersects the pressure balancing passage $27_1$. In the present exemplary embodiment the interference jet passage 37 is formed by an axial through-hole 38 from which, on the side of the control plate 18 remote from the control surface 17, a radial groove 39 leads to the output line 21. The distance a of the opening 36 o the interference jet passage 37 from the neighbouring end of the LP-control passage 23 is preferably about the same as the diameter b of the throughput passages 24, 25. By this means it is ensured that the interference jet passage 37 is substantially only opened by the control edge 41 of the respective adjoining throughput passage 24/25 when the throughput passage 24/25 has left the LP-control passage 22. Additional volumetric losses are thereby prevented.

When the axial piston pump 1 is in operation, when the opening 33 of the interference jet passage 37 is intersected by the control edge 41 of the respective throughput passage 24/25, there is a gentle pressure balancing in the throughput passage 24/25 containing low pressure before this passage is connected with the output line 21, i.e. with the high pressure. Since the two fluid streams and/or fluid jets flowing into the respective throughput passage 24/25 intersect, a resulting flow or a resulting jet region is produced whose naturally high kinetic energy is destroyed or substantially reduced by the intersection of the jets or streams. Jet erosion of the piston bore walls 11, namely at 43, and cavitation erosion of the control surface face 17, namely in the region and near the opening 33 of the pressure balancing passage $27_1$, namely at 44, is thereby avoided. A jet such as that which arises when there is no interference jet passage 37 is indicated by 45.

Within the scope of the invention it is also possible to arrange the opening 36 of the interference jet passage 37 in the direction of the jet behind the opening 33 of the pressure balancing passage 27, for example at 46. In an arrangement such as this, the resulting jets intersect outside the pressure balancing passage 27. This is also effective in avoiding jet erosion of the piston bore wall, which is of particular importance because a cylinder barrel 9 consists, for the lowest possible wear-resistance, of a relatively soft material, namely a bearing metal such as bronze. In the aforementioned alternative arrangement, the effectiveness of the prevention of jet erosion of the control surface face 17 is less efficient than when the interference jet passage 37 opens into the pressure balancing passage 27.

In the transition region, indicated by 30, taking into consideration the direction of rotation 31 from the HP region to the LP region, an interference jet passage 37 of the kind described can be dispensed with because the streams or jets which arise in this transition region 30 when the axial piston pump is in operation have a less harmful effect.

The arrangement according to the invention is also suitable for operation of an axial piston machine as a motor. In this case, owing to the reversed direction of rotation, a pressure balancing passage $27_3$ should be associated with an interference jet passage 37 in a corresponding arrangement starting from the high pressure in the transition region indicated by 30 (see outline representation). For pump and motor operation, both pressure balancing passages $27_1$, $27_3$ should be provided with interference jet passages 37 while, in order to prevent losses, the interference jet passage $27_2$ should not be provided.

What is claimed is:

1. An axial piston machine of the swashplate or bent axis type having slot control and a pressure balancing passage at the inlet end of the high pressure (HP) control slot, characterised in that at the inlet end of the HP-control slot an interference jet passage starting from the high pressure is provided whose opening is arranged so that the streams of liquid issuing from the pressure balancing passage and the outlet of the interference jet passage intersect.

2. An axial piston machine according to claim 1, characterised in that the direction of flow of the outlet of the interference jet passage is aligned approximately at right angles to the direction of flow of the pressure balancing passage.

3. An axial piston machine according to claim 1, characterised in that the interference jet passage has a section proceeding substantially radially from the high pressure and a section that continues substantially axially.

4. An axial piston machine according to claim 1, characterised in that the control slots are provided in a control plate and the interference jet passage runs within the control plate.

5. An axial piston machine according to claim 4, characterised in that the interference jet passage comprises an axial bore and a substantially radial passage section, in particular a groove, on the side of the control plate remote from the cylinder openings.

6. An axial piston machine according to claim 1, characterised in that the opening of the interference jet passage is arranged near or in the opening of the pressure balancing passage.

7. An axial piston machine according to claim 1, characterised in that the pressure balancing passage is formed by a notch starting from the HP-control slot and in particular diverging towards the latter, said notch being shorter or preferably longer than the distance (a) between two neighbouring throughput passages in the cylinder barrel.

8. An axial piston machine according to claim 7, characterised in that the opening of the interference jet passage is in the pressure balancing passage and is preferably arranged so that it only become uncovered when or after the respective throughput passage has left the low pressure (LP) passage.

9. An axial piston machine of the swash plate or bent axis type, comprising:

a housing including a low pressure passage and a high pressure passage;

a cylinder block supported for rotation in the housing and forming a plurality of piston bores; and a shaft extending into the housing and connected to the cylinder block to rotate therewith, wherein as the cylinder block rotates in the housing, the piston bores serially communicate with the high and low pressure passages;

the housing including a high pressure control slot to control the flow of high pressure fluid between the high pressure passage and the piston bores;

the housing defining a pressure balancing passageway in fluid communication with the high pressure passage to receive high pressure fluid therefrom, and having a discharge opening to discharge a stream of high pressure fluid into a piston bore approaching the high pressure passage before that piston bore comes into direct communication with the control slot; and the housing further defining an interference jet passage in fluid communication with the high pressure passage to receive high pressure fluid therefrom, and having a discharge opening to discharge a jet of high pressure fluid into said stream of high pressure fluid to reduce the impact of said stream on surfaces of the axial piston machine.

10. An axial piston machine according to claim 9 wherein the discharge opening of the interference jet passage is positioned adjacent or in the discharge opening of the pressure balancing passage.

11. An axial piston machine according to claim 10, wherein the discharge opening of the interference jet passage is in the pressure balancing passage.

12. An axial piston machine according to claim 10, wherein:

the cylinder block defines an axis; and the interference jet passage includes (i) a first section in communication with and radially extending from the high pressure passage, and (ii) a second section in communication with an axially extending from said first section, and forming the discharge opening of the interference jet passage.

13. An axial piston machine according to claim 10, wherein:

the housing further includes a control plate disposed between the cylinder block and the high and low pressure passages; and the control plate forms both the pressure balancing passageway and the interference jet passage.

* * * * *